US011541619B2

(12) United States Patent
Kibler

(10) Patent No.: US 11,541,619 B2
(45) Date of Patent: Jan. 3, 2023

(54) HERB OIL PRESSING DEVICE AND RELATED METHOD OF PRESSING HERBS

(71) Applicant: 1769474 ALBERTA LTD., Edmonton (CA)

(72) Inventor: Tyler Kibler, Calmar (CA)

(73) Assignee: 1769474 ALBERTA LTD., Edmonton (CA)

( * ) Notice: Subject to any disclaimer, the term of this patent is extended or adjusted under 35 U.S.C. 154(b) by 167 days.

(21) Appl. No.: 17/042,023

(22) PCT Filed: Mar. 26, 2019

(86) PCT No.: PCT/CA2019/050367

§ 371 (c)(1),
(2) Date: Sep. 25, 2020

(87) PCT Pub. No.: WO2019/183721

PCT Pub. Date: Oct. 3, 2019

(65) Prior Publication Data

US 2021/0078278 A1 Mar. 18, 2021

Related U.S. Application Data

(60) Provisional application No. 62/648,222, filed on Mar. 26, 2018.

(51) Int. Cl.
*B30B 9/10* (2006.01)
*B30B 9/04* (2006.01)
(Continued)

(52) U.S. Cl.
CPC ..... *B30B 9/047* (2013.01); *B30B 9/10* (2013.01); *B30B 15/064* (2013.01); *C11B 1/08* (2013.01)

(58) Field of Classification Search
CPC .. C11B 1/06; C11B 1/08; B30B 1/006; B30B 1/007; B30B 1/10; B30B 1/103;
(Continued)

(56) References Cited

U.S. PATENT DOCUMENTS 134,021 A * 12/1872 Williams ..... B30B 1/103 100/244
2,220,372 A 11/1940 Johnson
(Continued)

FOREIGN PATENT DOCUMENTS

CA 2997976 A1 9/2018
CN 207240971 U 4/2018
(Continued)

OTHER PUBLICATIONS

International Search Report dated Jun. 14, 2019, issued in corresponding International Application No. PCT/CA2019/050367, filed Mar. 26, 2019, 5 pages.
(Continued)

*Primary Examiner* — Matthew Katcoff
(74) *Attorney, Agent, or Firm* — Christensen O'Connor Johnson Kindness PLLC

(57) ABSTRACT

Herb oil pressing devices and methods are provided. The devices include a pair of closable opposed jaws that can apply pressure to a herb placed between the jaws; a motor connected to the jaws for controlling the closing of the jaws, and, when closed, controlling the pressure produced between the jaws; a heater connected to the jaws for heating the jaws and herb; a housing in which the jaws, the motor, and the heater are housed; and a user interface connected to the jaws and the heater, the user interface for inputting a selection of temperature, pressure, and amount of time the temperature and pressure is applied to a herb positioned between the jaws to extract oil therefrom. Related computer-implemented methods of pressing a herb are also provided.

15 Claims, 4 Drawing Sheets

(51) Int. Cl.
*B30B 15/06* (2006.01)
*C11B 1/08* (2006.01)

(58) Field of Classification Search
CPC ..... B30B 1/16; B30B 11/00; B30B 15/064; B30B 15/26; B30B 15/34; B30B 9/04; B30B 9/047; B30B 9/065; B30B 9/10; B30B 9/12; B30B 9/28
See application file for complete search history.

(56) References Cited

U.S. PATENT DOCUMENTS

| | | | | |
|---|---|---|---|---|
| 4,073,180 | A * | 2/1978 | Pahnke | B21K 1/761 72/453.01 |
| 5,141,586 | A * | 8/1992 | Myers | B30B 15/064 100/319 |
| 10,882,266 | B2 * | 1/2021 | Britton | B30B 9/047 |
| 2003/0094739 | A1 | 5/2003 | Isobe et al. | |
| 2016/0000135 | A1 | 1/2016 | Evans et al. | |
| 2017/0080660 | A1 | 3/2017 | Lucas | |
| 2017/0095988 | A1 * | 4/2017 | Rauschenberger | B30B 15/14 |
| 2018/0008655 | A1 | 1/2018 | Weikel | |
| 2019/0291376 | A1 * | 9/2019 | Xu | B30B 9/04 |

FOREIGN PATENT DOCUMENTS

| | | | |
|---|---|---|---|
| WO | 9956599 | A1 | 11/1999 |
| WO | 2013134364 | A1 | 9/2013 |
| WO | 2015191738 | A1 | 12/2015 |
| WO | 2018227266 | A1 | 12/2018 |

OTHER PUBLICATIONS

Written Opinion of the International Searching Authority dated Jun. 14, 2019, issued in corresponding International Application No. PCT/CA2019/050367, filed Mar. 26, 2019, 7 pages.

* cited by examiner

HERB OIL PRESSING DEVICE AND RELATED METHOD OF PRESSING HERBS

TECHNICAL FIELD

This disclosure relates to devices and methods for pressing herbs, and more particularly pressing herbs to extract oils therefrom.

BACKGROUND

It can be desirable to press herbs to extract oils within the herbs. However, the quality and quantity of the oil extracted will depend on not only the type or variety of herb from which the oil is extracted, but also the specific pressure applied to the herb, the amount of time of applying the pressure, and the temperature at which the pressure is applied. For example, applying relatively high pressure, for a relatively short period of time, at relatively high heat may result in desired composition, quantity, and quality of oil in one situation, whereas in another situation it may be desirable to apply a relatively lower pressure, for a relatively longer period of time, at a relatively lower temperature.

Manual herb oil presses are available, but it can be difficult to repeat with accuracy a specific pressing procedure (e.g., the pressure applied, temperature at which the pressure is applied, and amount of time of applying the pressure and temperature) that results in a desired oil extraction. Automatic herb oil presses are also available that can repeat a specific pressing procedure, but can be limited to only one particular pressing procedure, which may not be optimal for the user's needs. Further, many automatic herb oil press designs may not create sufficient pressure to extract oil from some herbs. Some automatic herb oil press designs utilize a hydraulic press to press the herbs, which makes these automatic herb oil presses bulky, expensive, and not suitable for personal or small-scale use.

Further, herb oil presses are not currently available that allow a pressing procedure to be shared between pressing devices. Sharing pressing procedures between devices can allow for different users to share a herb pressing procedure that has proven successful in extracting a desired oil from a specific type or variety of herb.

Accordingly, there is a need for herb oil press devices and methods that can enable the user to fully control, customize, and accurately repeat herb pressing procedures for personal or small-scale use. Further, it is desirable to have a herb oil pressing device that can allow a user to save and share various herb pressing procedures with others.

SUMMARY OF THE INVENTION

Herb oil pressing devices and methods are provided. In some embodiments, the devices can comprise a pair of closable opposed jaws that can apply a pressure to a herb placed between the jaws; a motor operatively connected to the jaws for controlling the closing of the jaws, and, when closed, controlling the pressure produced between the jaws; a heater operatively connected to the jaws for heating the jaws and herb; a housing in which the jaws, the motor, and the heater are housed; and a user interface operatively connected to the jaws and the heater, the user interface for inputting a selection of temperature, pressure, and amount of time the temperature and pressure is applied to a herb positioned between the jaws to extract oil therefrom. Related computer-implemented methods of pressing a herb are also provided.

Broadly stated, in some embodiments, a herb pressing device is provided which comprises: a pair of opposed jaws for receiving a herb and that are closable to apply pressure to the herb when placed between the jaws; a motor operatively connected to the jaws for controlling the closing of the jaws, and, when closed, controlling the pressure produced between the jaws; a heater operatively connected to the jaws for heating the jaws; a housing in which the jaws, the motor, and the heater are housed; and a control panel in communication with the housing and operatively connected to the jaws and the heater for selectively heating and creating a pressure between the jaws for extracting oil from the herb when placed between the jaws.

In some embodiments, the herb pressing device comprises: a pair of opposed jaws for receiving a herb and that are closable to apply pressure to the herb when placed between the jaws; a jaws controller operatively connected to the jaws for controlling the closing of the jaws and, when closed, controlling the pressure produced between the jaws; a heater operatively connected to the jaws for heating the jaws; a processor operatively connected to the jaws controller and the heater; and a non-transitory storage medium storing instructions readable by the processor to: actuate the heater to heat the jaws to a predetermined temperature; and actuate the jaws controller to close the jaws and apply a predetermined pressure to the herb; and maintain the predetermined temperature and pressure on the herb for a predetermined amount of time.

Broadly stated, in some embodiments, a computer implemented method for pressing a herb positioned between a pair of opposed jaws is provided, the method comprising: actuating a heater to heat the jaws to a predetermined temperature; actuating a jaws controller to close the jaws and apply a predetermined pressure to the herb; and maintaining the predetermined temperature and pressure for a predetermined amount of time.

BRIEF DESCRIPTION OF THE DRAWINGS

The devices and methods will now be described by way of exemplary, non-limiting, embodiments with reference to the accompanying drawings, in which.

DETAILED DESCRIPTION OF THE PREFERRED EMBODIMENTS

Herb oil pressing devices and related methods of pressing herbs are provided.

In some embodiments, the devices can comprise a pair of closable opposed jaws that can apply a pressure to a herb placed between the jaws; a motor operatively connected to the jaws for controlling the closing of the jaws, and, when closed, controlling the pressure produced between the jaws; a heater operatively connected to the jaws for heating the jaws and herb; a housing in which the jaws, the motor, and the heater are housed; and a user interface operatively connected to the jaws and the heater, the user interface for inputting a selection of temperature, pressure, and amount of time the temperature and pressure is applied to a herb positioned between the jaws to extract oil therefrom. Related computer-implemented methods of pressing a herb are also provided.

Figure 1:
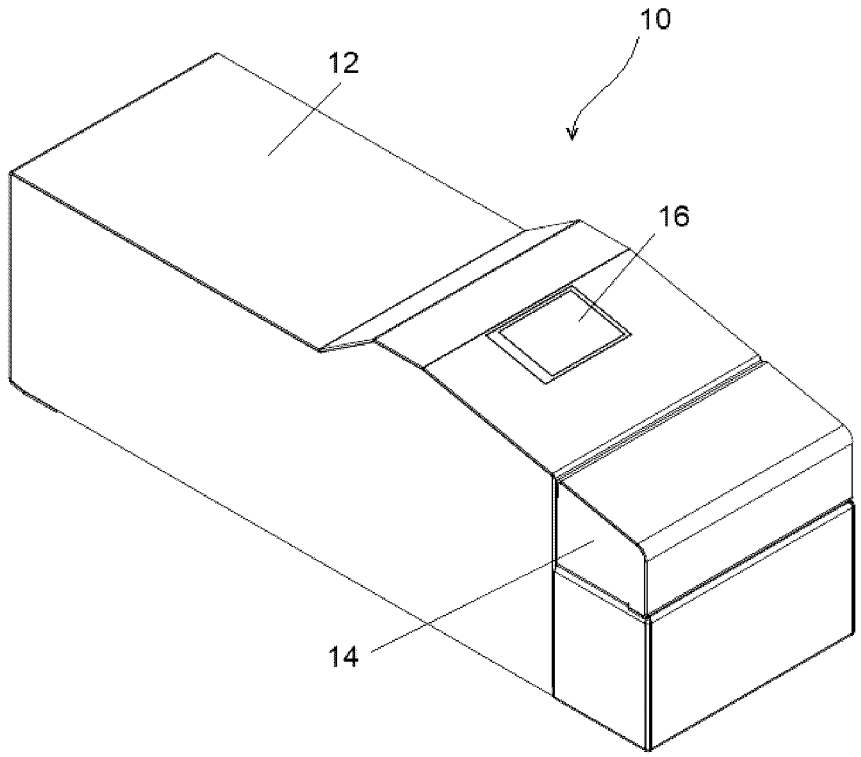
FIG. 1 is a perspective view of an embodiment of a herb pressing device.

Referring to FIG. 1, a perspective view of an embodiment of a herb oil pressing device 10 is shown. Herb oil pressing device 10 can include a housing 12 and door 14, which can allow access to position a herb (not shown) within the herb oil pressing device 10 to extract oil therefrom. In some embodiments, door 14 can act as a safety door where device 10 is configured to not operate unless door 14 is in a closed position.

In some embodiments, user interface 16 can be positioned on housing 12. In some embodiments, user interface 16 can be an LCD/touch screen display to present to a user setting options and present conditions of device 10. The user interface 16 can allow a user to input selecting settings into herb oil pressing device 10 to be used when extracting oil.

Figure 2:
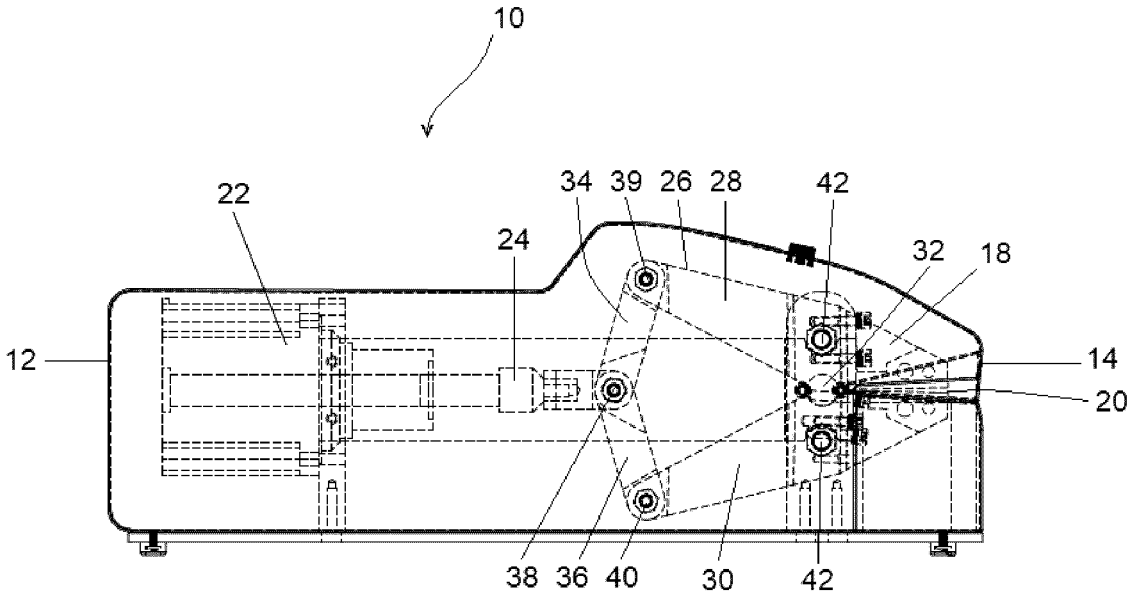
FIG. 2 is a side elevation, cross-sectional view of the embodiment shown in FIG. 1.

Referring now to FIG. 2, herb oil pressing device 10 can comprise a pair of opposed jaws 18 that are closable and can apply pressure to a herb placed in a space 20 that is located between jaws 18. A jaws controller 22 can be used to control the closing of jaws 18 and, when closed, controlling the pressure produced between jaws 18 in order to extract oil from the herb. In some embodiments, jaws controller 22 can be an electric motor having a selectively extendible motor arm 24. Jaws controller 22 can be operatively connected to jaws 18 by connection mechanism 26 between motor arm 24 and jaws 18. Connection mechanism 26 can be configured so that movement of jaws 18 can be controlled by extension and retraction of motor arm 24.

In some embodiments, jaws 18 can comprise a first jaw arm 28 and a second jaw arm 30. The first jaw arm 28 can be pivotably attached to the second jaw arm 30 at a first attachment point 32. The first attachment point 32 can positioned so that it is spaced from the ends of the first and second jaw arms 28, 30 and can held immovable within the housing 12. In this way, pivoting of the first and second jaw arms 28, 30 with respect to each other at the first attachment point 32 can cause the jaws 18 to open and close like a pair of scissors. Pressure can be created between the jaws 18, when closed, by applying an outward force to the first jaw arm 28 and the second jaw arm 30.

In some embodiments, the motor arm 24 can be operatively connected to the jaws 18 via a first connection arm 34 and a second connection arm 36. The first and second connection arms 34, 36 can be pivotably attached and extend away from the motor arm 24 at a second attachment point 38. Further, the first connection arm 34 can be pivotably attached to the first jaw arm 28 at a third attachment point 39 and the second connection arm 36 can be pivotably attached to the second jaw arm 30 at a fourth attachment point 40. Lastly, the third and fourth attachment points 39, 40 can be spatially separated.

Utilizing this type of articulated arm assembly for connection mechanism 26 can result in an arrangement where extension of motor arm 24 can result in pivoting of jaws 18 at the first attachment point 32 using the first and second connection arms 34, 36. Extension of the motor arm 24 can result in an outward force being applied to first and second jaw arm 28, 30 until the jaws 18 close, and then an extension force created by motor 22 on motor arm 24 results in the creation of pressure between the jaws 18. The greater the extension force, the greater the pressure created between jaws 18. In some embodiments, the pressure created by jaws 18 can be up to 500 pounds per square inch. In some embodiments, the pressure created by jaws 18 can be up to 2000 pounds per square inch.

In some embodiments, jaws 18 can include a chamfered ball and cup formed on the two surfaces of jaws 18 that come together when jaws 18 close. The oil extracted by jaws 18 can be collected in the cup for convenient collection.

Figure 3:
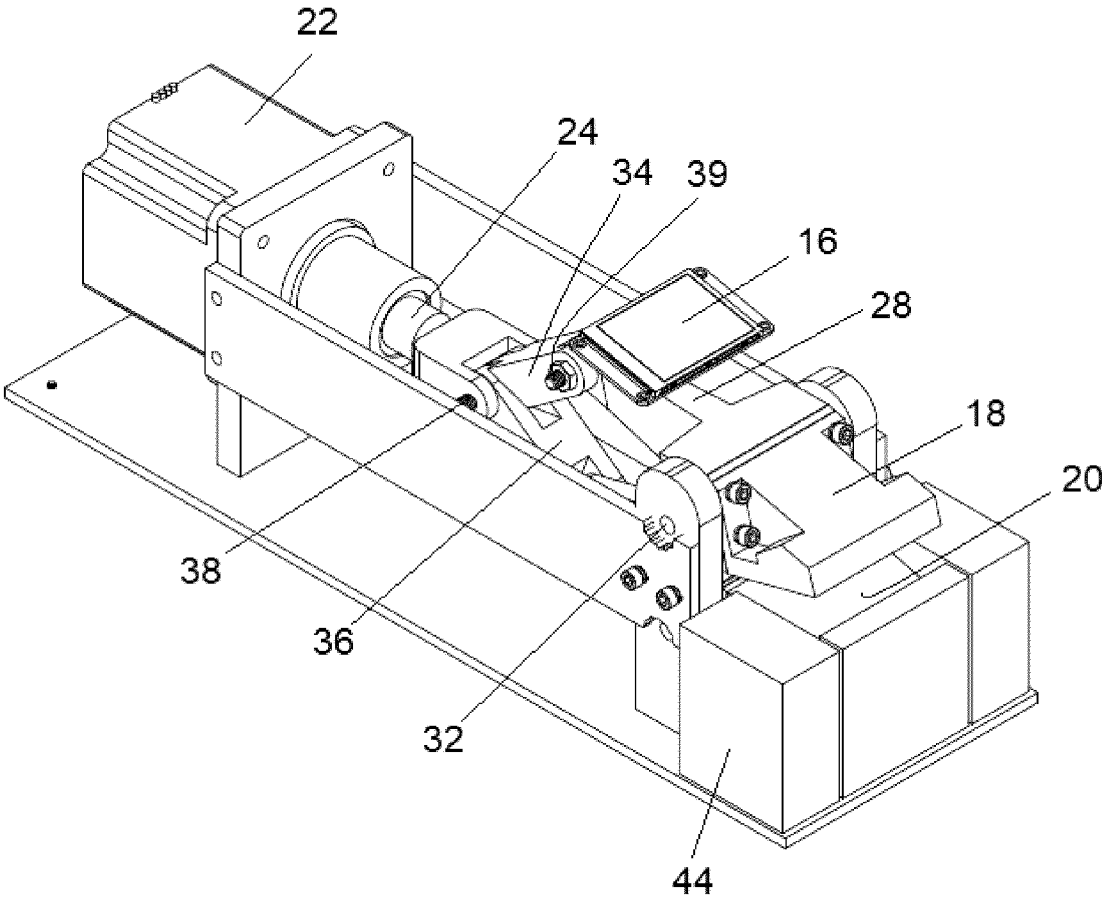
FIG. 3 is a perspective view of the embodiment shown in FIG. 1 with the housing removed.

In some embodiments, a heater 42 can be included in the herb oil pressing device 10 and can be operatively connected to jaws 18 and used to heat jaws 18. Heat added to jaws 18 prior to, and/or during, extraction can assist in extraction of oil from the herb and/or improve the quality of the oil extracted. In some embodiments heater 42 can be embedded into a block of material, such as aluminum, to act as heating blocks and provide for even heat distribution. In some embodiments, device 10 can further include a cooling means, such as cooling blocks 44 (see FIG. 3), to help maintain or lower the temperature of jaws 18 and device 10.

Figure 4:
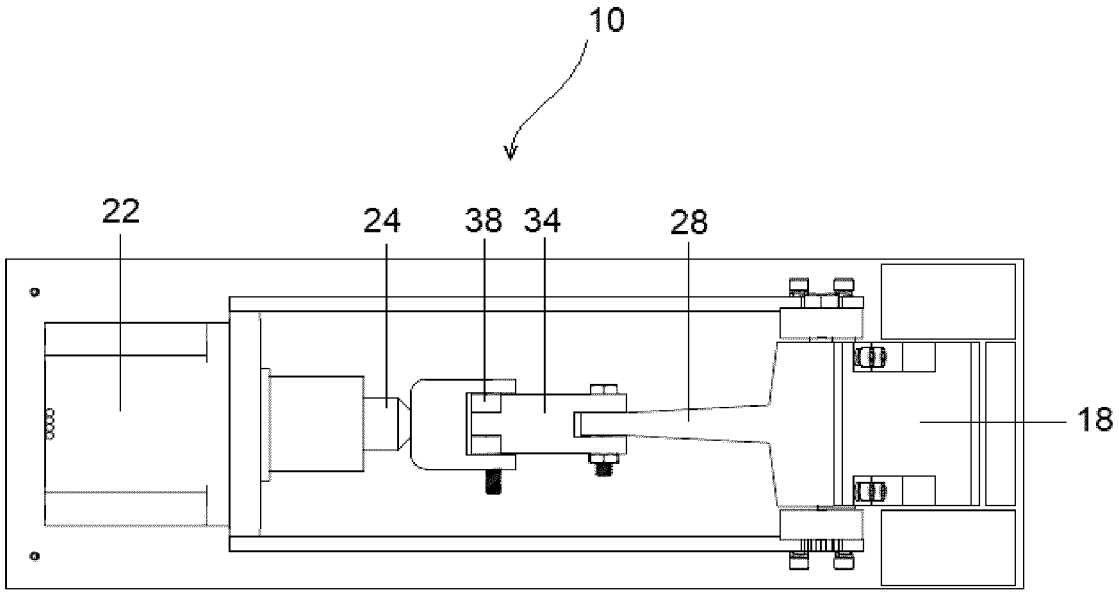
FIG. 4 is a top plan view of the embodiment shown in FIG. 1 with the housing removed.
Figure 5:
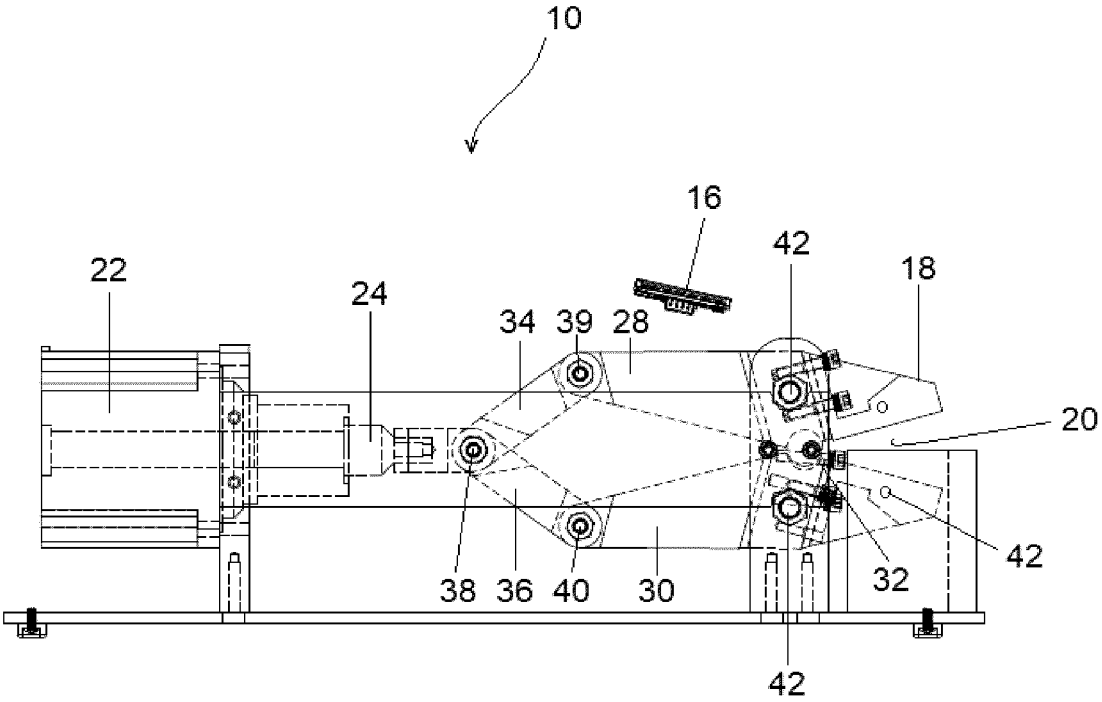
FIG. 5 is a side elevation, cross-sectional view of the embodiment shown in FIG. 1 with the housing removed.

FIG. 4 and FIG. 5 show additional views of an embodiment of device 10.

In some embodiments, herb oil pressing device 10 can also include a processor operatively connected to jaws controller 22 and/or heater 42. Further still, the herb oil pressing device 10 can include a non-transitory storage medium storing instructions readable by the processor. In some embodiments, the instructions, when read, can cause the processor to: actuate the heater 42 to heat the jaws 18 to a predetermined temperature; actuate the jaws controller 22 to close the jaws 18 and apply a predetermined pressure to the herb; and maintain the predetermined temperature and pressure on the herb for a predetermined amount of time.

In some embodiments, the predetermined temperature, the predetermined pressure, and the predetermined amount of time is inputted by a user via a user interface 16 positioned on the housing 12.

In some embodiments, the herb oil pressing device 10 can further comprise a communications component operatively connected to the storage medium, the communications component for receiving, via a communication network, from a user operated computer device an input made by the user on the user operated computer device of the predetermined temperature, the predetermined pressure, and the predetermined amount of time.

In some embodiments, the communications component can further transmit an actual temperature applied by the jaws 18, an actual pressure applied to the herb by the jaws 18, and an actual amount of time the actual temperature and actual pressure is applied to the herb to the user operated computer device via the communications network. Therefore, the user can track the process of extraction of oils from the herb in device 10 as it happens, or in "real-time".

In some embodiments, the user operated computer device comprises one of a general purpose desktop computer, a laptop computer, a tablet computer, or a smartphone. In some embodiments, the communications network comprises one of cable-connected buses, a wireless local area network (WLAN), a near field communication network, a client-server network, a cellular telephone network, an infrared network, or a satellite network.

Accordingly, the herb oil pressing device 10 can be a relatively convenient and economical device to extract oils from herbs. The device 10 can be small enough to fit on a countertop, for example, of a kitchen, or desktop. Also, the predetermined temperature, the predetermined pressure, and the predetermined amount of time can be inputted by the user to customize the extraction of oil from a particular herb.

The predetermined temperature, the predetermined pressure, and the predetermined amount of time can be saved, or otherwise stored, on device 10 and repeated when desired. Further, these selections can be shared to other devices 10. Therefore, a single extraction procedure can accurately and consistently take place on multiple devices 10 simultaneously or at different times. If one user finds that an extraction procedure extracts a desirable quantity and/or quality of oil from a particular type or variety of herb, then this extraction procedure can be shared with other users.

Figure 6:
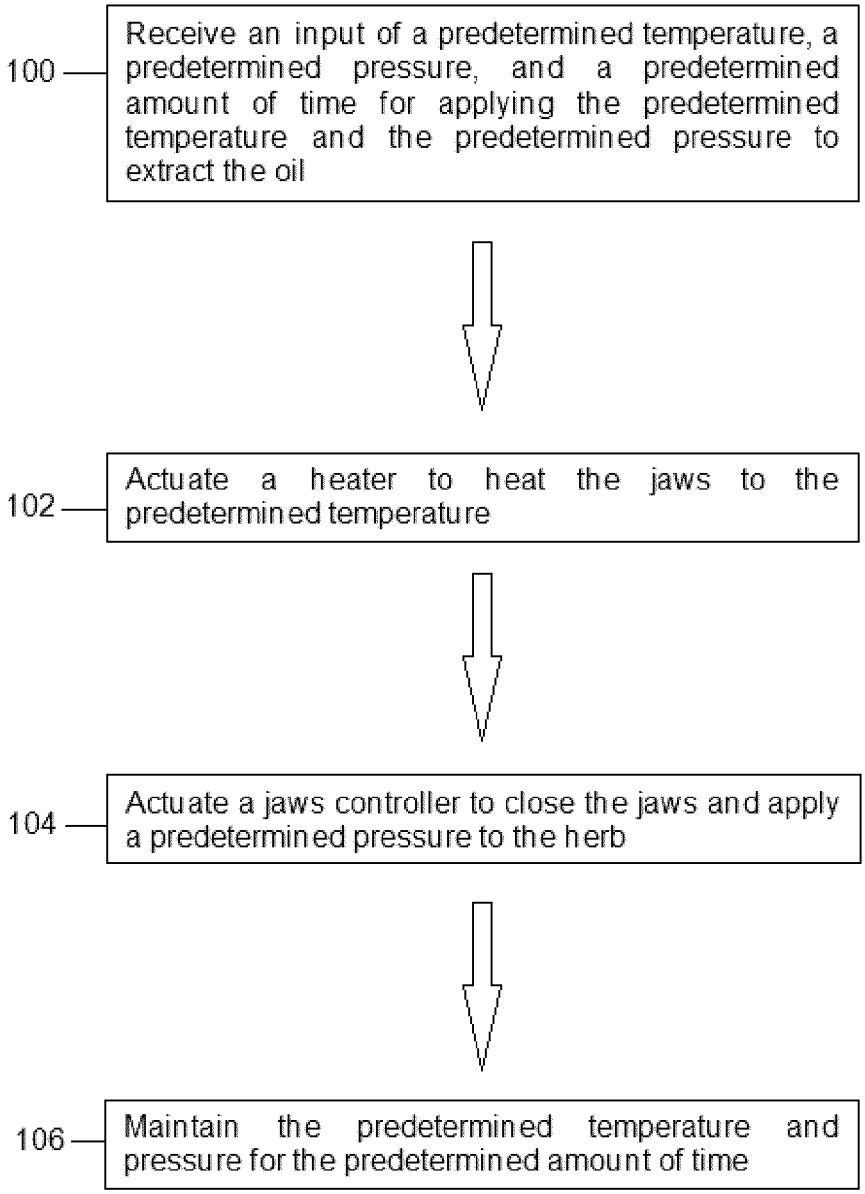
FIG. 6 is a diagram of an embodiment of a computer implemented method of pressing a herb.

Referring now to FIG. 6, embodiments of computer implemented methods are provided for extracting oil by pressing a herb positioned between a pair of opposed jaws. A user can place herb between the jaws 18. At step 100, predetermined temperature, predetermined pressure, and predetermined amount of time can be inputted into the herb oil pressing device 10 from a selection made by a user. This input step can be accomplished using a user interface 16 on the housing 12 of the device 10 or through transmission, via a communication network, from a user operated computer device, which is used by the user to input the selection. At step 102, a heater 42 can be actuated to heat the jaws 18 to the predetermined temperature that has been selected or input by the user. At step 104, a jaws controller 21 can be actuated to close jaws 18 and apply the predetermined pressure to the herb. At step 106, the predetermined temperature and the predetermined pressure can be maintained by jaws 18 on the herb for a predetermined amount of time. In some embodiments, the method can further comprise transmitting, via a communication network, an actual temperature applied by the jaws, an actual pressure applied to the herb by the jaws, and an actual amount of time the actual temperature and actual pressure is applied to the herb to a user operated computer device. Transmission to the user can allow the user to monitor the extraction process on the user operated computer device as it happens in device 10.

Therefore, the computer implemented methods can allow for the predetermined temperature, the predetermined pressure, and the predetermined amount of time to be inputted and changed by the user to customize the extraction of oil from a particular herb.

It should be apparent, however, to those skilled in the art that many more modifications besides those already described are possible without departing from the inventive concepts herein. The inventive subject matter, therefore, is not to be restricted except in the scope of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly reference.

In particular, the terms "computer," "processor," and "memory" all refer to electronic or other technological devices. As used herein, the term "computer readable medium" refers generally to a tangible, physical, and non-transitory electronic storage medium that stores information in a form that is readable by a computer.

Aspects of this disclosure may be embodied as a system, method or computer program product, and may take the form of an entirely hardware embodiment, an entirely software embodiment (including firmware, resident software, micro-code, etc.) or an embodiment combining software and hardware aspects that may all generally be referred to as a module or system. Furthermore, aspects of this disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of this disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

These computer program instructions may be provided to a processor of a general purpose computer, special purpose computer, or other programmable data processing apparatus to produce a machine, such that the instructions, which execute via the processor of the computer or other programmable data processing apparatus, create means for implementing the methods described herein.

These computer program instructions may also be stored in a computer readable medium that can direct a computer, other programmable data processing apparatus, or other devices to function in a particular manner, such that the instructions stored in the computer readable medium produce an article of manufacture including instructions which implement the methods described herein.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the methods described herein.

Although particular embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A herb pressing device comprising:

a pair of opposed jaws for receiving a herb and that are closable to apply pressure to the herb when placed between the jaws, wherein the jaws comprise a first jaw arm having ends, and a second jaw arm having ends, the first jaw arm is pivotably attached to the second jaw arm at a first attachment point, and the first attachment point is spaced from the ends of the first and second jaw arms;

a jaws controller operatively connected to the jaws for controlling the closing of the jaws and, when closed, controlling the pressure produced between the jaws, the jaws controller comprising a motor comprising a motor arm that is selectively extendible; the motor operatively connected to the jaws via first and second connection arms, wherein the first and second connection arms are pivotably attached and extend away from the motor arm at a second attachment point, the first connection arm is pivotably attached to the first jaw arm at a third attachment point, the second connection arm is pivotably attached to the second jaw arm at a fourth attachment point, and the third and fourth attachment points are spatially separated, wherein extension of the motor arm brings the jaws together;

a heater operatively connected to the jaws for heating the jaws;

a processor operatively connected to the jaws controller and the heater; and a non-transitory storage medium storing instructions readable by the processor to:

actuate the heater to heat the jaws to a predetermined temperature;

actuate the jaws controller to close the jaws and apply a predetermined pressure to the herb; and maintain the predetermined temperature and pressure on the herb for a predetermined amount of time.

2. The device of claim 1, wherein the predetermined temperature, the predetermined pressure, and the predetermined amount of time is input by a user via a user interface in communication with the herb pressing device.

3. The device of claim 1, the device further configured to receive, via a communication network, from a user operated computer device an input made by the user on the user operated computer device of the predetermined temperature, the predetermined pressure, and the predetermined amount of time.

4. The device of claim 3, wherein the the device transmits an actual temperature applied by the jaws, an actual pressure applied to the herb by the jaws, and an actual amount of time the actual temperature and actual pressure is applied to the herb to the user operated computer device via the communications network.

5. The device of claim 3, wherein the user operated computer device comprises one of a general purpose desktop computer, a laptop computer, a tablet computer, or a smartphone.

6. The device of claim 3, wherein the communications network comprises one of cable-connected buses, a wireless local area network, a near field communication network, a client-server network, a cellular telephone network, an infrared network, or a satellite network.

7. The device of claim 1, further comprising a housing for housing the jaws, the jaws controller, the heater, the processor, and the non-transitory storage medium.

8. The device of claim 7, further comprising a door on the housing positioned proximate the jaws that is openable to allow access between the jaws for inserting the herb.

9. The device of claim 1, wherein the jaw further comprise a chamfered ball and cup formed on two surfaces of the jaws that close together.

10. A herb oil pressing device, comprising:

a pair of opposed jaws for receiving a herb and that are closable to apply pressure to the herb when placed between the jaws, wherein the jaws comprise a first jaw arm having ends, and a second jaw arm having ends, the first jaw arm is pivotably attached to the second jaw arm at a first attachment point, and the first attachment point is spaced from the ends of the first and second jaw arms;

a motor operatively connected to the jaws for controlling the closing of the jaws, and, when closed, controlling the pressure produced between the jaws comprising a motor arm that is selectively extendible; the motor operatively connected to the jaws via first and second connection arms, wherein the first and second connection arms are pivotably attached and extend away from the motor arm at a second attachment point, the first connection arm is pivotably attached to the first jaw arm at a third attachment point, the second connection arm is pivotably attached to the second jaw arm at a fourth attachment point, and the third and fourth attachment points are spatially separated wherein extension of the motor arm brings the jaws together;

a heater operatively connected to the jaws for heating the jaws;

a housing in which the jaws, the motor, and the heater are housed; and a control panel in communication with the housing and operatively connected to the jaws and the heater for selectively heating and creating a pressure between the jaws for extracting oil from the herb when placed between the jaws.

11. A computer implemented method for pressing a herb positioned between a pair of opposed jaws, wherein the jaws comprise a first jaw arm having ends, and a second jaw arm having ends, the first jaw arm is pivotably attached to the second jaw arm at a first attachment point, and the first attachment point is spaced from the ends of the first and second jaw arms, the method comprising:

actuating a heater to heat the jaws to a predetermined temperature;

actuating a jaws controller to close the jaws and apply a predetermined pressure to the herb, wherein the jaws controller comprises a motor comprising a motor arm that is selectively extendible; the motor operatively connected to the jaws via first and second connection arms, wherein the first and second connection arms are pivotably attached and extend away from the motor arm at a second attachment point, the first connection arm is pivotably attached to the first jaw arm at a third attachment point, the second connection arm is pivotably attached to the second jaw arm at a fourth attachment point, and the third and fourth attachment points are spatially separated, wherein extension of the motor arm brings the jaws together; and maintaining the predetermined temperature and pressure for a predetermined amount of time.

12. The method of claim 11, further comprising receiving an input of the predetermined temperature, the predetermined pressure, and the predetermined amount of time from a selection made by a user.

13. The method of claim 12, wherein receiving the input comprises input by the user of the predetermined temperature, the predetermined pressure, and the predetermined amount of time from via a user interface.

14. The method of claim 12, wherein receiving the input comprises receiving, via a communication network, from a user operated computer device an input made by the user on the user operated computer device of the predetermined temperature, the predetermined pressure, and the predetermined amount of time.

15. The method of claim 11, further comprising transmitting, via a communication network, an actual temperature applied by the jaws, an actual pressure applied to the herb by the jaws, and an actual amount of time the actual temperature and actual pressure is applied to the herb to a user operated computer device.

* * * * *